US009943210B2

(12) United States Patent
Kramer et al.

(10) Patent No.: US 9,943,210 B2
(45) Date of Patent: Apr. 17, 2018

(54) WAREWASHER WITH AUTOMATED SCRAPPING SYSTEM

(71) Applicants: Steven H. Kramer, Osgood, OH (US); Nicholas T. Weiss, Huber Heights, OH (US); Gary A. Gerber, Troy, OH (US)

(72) Inventors: Steven H. Kramer, Osgood, OH (US); Nicholas T. Weiss, Huber Heights, OH (US); Gary A. Gerber, Troy, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 388 days.

(21) Appl. No.: 14/680,098

(22) Filed: Apr. 7, 2015

(65) Prior Publication Data

US 2015/0327748 A1 Nov. 19, 2015

Related U.S. Application Data

(60) Provisional application No. 61/992,295, filed on May 13, 2014.

(51) Int. Cl.

| | |
|---|---|
| ***A47L 15/42*** | (2006.01) |
| ***B08B 3/14*** | (2006.01) |
| ***A47L 15/24*** | (2006.01) |

(52) U.S. Cl.

CPC ..... *A47L 15/4219* (2013.01); *A47L 15/247* (2013.01); *A47L 15/4202* (2013.01); *A47L 15/4208* (2013.01); *B08B 3/14* (2013.01); *A47L 15/24* (2013.01); *A47L 15/4206* (2013.01); *A47L 2401/20* (2013.01); *A47L 2401/34* (2013.01); *A47L 2501/34* (2013.01)

(58) Field of Classification Search

CPC ..... A47L 15/24; A47L 15/241; A47L 15/247; A47L 15/4202; A47L 15/4204; A47L 15/4206; A47L 15/4208

See application file for complete search history.

(56) References Cited

U.S. PATENT DOCUMENTS

| | | | |
|---|---|---|---|
| 3,375,835 | A | 4/1968 | Lopp et al. |
| 3,425,078 | A | 2/1969 | Lazaga |
| 5,097,855 | A | 3/1992 | Martinsson et al. |
| 6,079,427 | A | 6/2000 | Perry, Jr. |
| 8,303,726 | B2 | 11/2012 | Beaudet et al. |
| 8,881,750 | B2 | 11/2014 | Braun et al. |
| 2008/0041419 | A1 | 2/2008 | Gaus |

(Continued)

FOREIGN PATENT DOCUMENTS

| | | |
|---|---|---|
| DE | 1128094 | 4/1962 |
| DE | 3102547 | 9/1982 |
| DE | 3842640 | 6/1990 |

(Continued)

OTHER PUBLICATIONS

PCT, International Search Report and Written Opinion, International Application No. PCT/US2015/030274; dated Aug. 10, 2015, 11 pages.

*Primary Examiner* — Mikhail Kornakov
*Assistant Examiner* — Natasha N Campbell
(74) *Attorney, Agent, or Firm* — Thompson Hine LLP

(57) ABSTRACT

A warewasher includes a scrap reducing arrangement located within a wash zone for capturing scrap debris falling downward toward a tank. The scrap reducing arrangement is configured to automatically deliver captured scrap debris away from the tank when liquid spraying within the wash zone ceases.

20 Claims, 5 Drawing Sheets

(56) References Cited

U.S. PATENT DOCUMENTS

2012/0199166 A1 8/2012 Braun et al.

FOREIGN PATENT DOCUMENTS

| | | |
|---|---|---|
| DE | 4131914 | 4/1993 |
| DE | 29823869 | 1/2000 |
| DE | 202005015387 | 1/2006 |
| DE | 102006026817 | 1/2008 |
| EP | 0455151 | 11/1991 |
| EP | 1649797 | 4/2006 |
| FR | 2613609 | 10/1988 |
| GB | 805489 | 12/1958 |
| GB | 2204482 | 11/1988 |
| WO | WO 2012/087554 | 6/2012 |

WAREWASHER WITH AUTOMATED SCRAPPING SYSTEM

TECHNICAL FIELD

This application relates generally to warewasher systems which are used in commercial applications such as cafeterias and restaurants and, more particularly, to an automated scrapping system useful in removing debris from a wash zone in such a warewasher.

BACKGROUND

Commercial warewashers commonly include a housing area which defines washing and rinsing zones for dishes, pots pans and other wares. In the pre-wash, wash and post-wash zones of pass through or continuous-type machines, water is typically pumped from a tank through a pump intake, delivered to the wares via a spraying operation and collected in the tank for re-use. A similar recirculation system is used in batch-type machines as well. In either case, food debris from the ware commonly falls down into the tank, and can build up to undesired levels in the tank. Other types of scrap may also fall into the tank. Debris catching baskets have been incorporated into the tanks in order to reduce the scrap debris level within the tanks, but with previous baskets arrangements the entire machine must be shut down in order to enable manual removal and emptying of the basket.

It would be desirable to provide a an arrangement that automatically removes scrap debris.

SUMMARY

A scrap reducing arrangement may configured to automatically deliver the captured food debris or other scrap debris or material (napkins, straws etc.) away from the tank when liquid spraying within the wash zone ceases.

In one aspect, a warewasher for washing wares includes a chamber for receiving wares, the chamber having at least one wash zone that includes a tank for collecting sprayed liquid of the wash zone and a liquid recirculation system for moving liquid from the tank to a spray arrangement of the wash zone. A scrap reducing arrangement is located within the wash zone for capturing scrap debris falling downward toward the tank. The scrap reducing arrangement is configured to automatically deliver captured scrap debris away from the tank when liquid spraying within the wash zone ceases.

In one implementation, the warewasher is a continuous-type warewasher wherein the wash zone is located upstream of a final rinse zone, and the warewasher includes a conveyor for moving wares in a conveyance direction through the chamber from the wash zone to the final rinse zone.

In one implementation, when liquid spraying in the wash zone ceases, water conditions in the wash zone cause a flushing of captured scrap debris along a purge flow passage away from the tank.

In one implementation, the scrap reducing arrangement includes a scrap collecting volume in the wash zone and a purge flow passage extending from the scrap collecting volume away from the wash zone. When liquid spraying within the wash zone ceases, water in suspension returns to the tank causing an increase in a water level of the tank to create a head pressure in the scrap collecting volume that causes a flushing operation from the scrap collecting volume along the purge flow passage.

In one implementation, the purge flow passage leads to a compartment external of the wash zone. The compartment including a strainer to capture flushed scrap debris and a drain outlet to permit flushed liquid to be drained.

In one implementation, the scrap collecting volume includes a flush outlet from which the purge flow passage extends. At least a portion of the purge flow passage extends upward so that part of the purge flow passage is higher than the flush outlet.

In one implementation, the scrap reducing arrangement includes: a scrap collecting bucket to which scrap debris is directed by water flows falling down into the tank, the scrap collecting bucket including a screening portion in fluid communication with the tank. A flow passage extends from a lower part of the scrap collecting bucket away from the tank, the flow passage configured such that (i) during liquid recirculation and spraying within the wash zone a water level in the tank is below a level that forces captured scrap debris along the flow passage and (ii) upon cessation of liquid recirculation and spraying within the wash zone the water level in the tank rises to a level that creates a head pressure to force capturing scrap debris and water to move along the flow passage.

In one implementation, the flow passage is configured such that upon cessation of liquid recirculation and spraying within the wash zone the water level in the tank rises to a level that causes a flushing operation along the flow passage.

In one implementation, the flow passage extends to a scrap collecting container. The scrap collecting container traps scrap debris but allows liquid to move to a drain path. The scrap collecting container includes a removable strainer.

In one implementation, a controller is configured to at least temporarily stop liquid recirculation and spraying in the wash zone based upon one or more of (i) a timed basis and/or (ii) detection of the absence of wares in the chamber and/or (iii) detection of debris within the scrap collecting bucket.

In another aspect, a warewasher for washing wares includes a chamber for receiving wares, the chamber includes a tank for collecting sprayed liquid of the wash zone and a liquid recirculation system for moving liquid from the tank to a spray arrangement of the wash zone. A scrap reducing arrangement is located within the wash zone for capturing scrap debris falling down toward the tank. The scrap reducing arrangement includes a scrap collecting volume positioned in the tank and into which falling scrap debris is directed. The scrap collecting volume includes an outlet opening, with a purge flow passage extending from the outlet opening to a location external of the wash zone. At least a portion of the purge flow passage extends upward so that a part of the purge flow passage is higher than the outlet opening.

In one implementation, the outlet opening is located below a normal water level of the tank that exists during liquid recirculation and spraying in the wash zone, and the part of the purge flow passage is higher than the normal water level.

In a further aspect, a method of capturing and purging scrap debris from a wash zone of a warewasher involves: recirculating a wash liquid from a tank of the wash zone to spray nozzles of the wash zone so as to spray the wash liquid toward wares in the wash zone; directing scrap debris falling from wares toward and into a scrap collecting volume within the tank, the scrap collecting volume including at least some screening material to remain in fluid communication with the tank, the scrap collecting volume including a scrap purge flow passage; at least temporarily stopping the recirculating of wash liquid, causing water conditions in the wash zone to change so as to move scrap debris in the scrap collecting volume along the scrap purge flow passage.

In one implementation of the method, upon stopping the recirculating of wash liquid a water level in the tank rises to a level that creates a head pressure to force scrap debris in the scrap collecting volume and water to move along the scrap purge flow passage.

In one implementation of the method, the directing step utilizes upper screening material configured to catch and direct scrap debris toward an upper opening of the scrap collecting volume.

In one implementation of the method, the scrap purge flow passage is configured such that upon stopping the recirculation of wash liquid the water level in the tank rises to a level that causes a flushing operation along the scrap purge flow passage, including a temporary siphon flow along the scrap purge flow passage until the water level in the tank drops to a level that breaks the siphon.

In one implementation of the method, the scrap purge flow passage includes an upwardly directed portion and extends to a scrap collecting container external of the wash zone.

In one implementation of the method, the external scrap collecting container traps scrap debris but allows liquid to move to a drain path.

In one implementation of the method, the external scrap collecting container includes a strainer that can be removed for disposal of collected scrap debris.

The details of one or more embodiments are set forth in the accompanying drawings and the description below. Other features, objects, and advantages will be apparent from the description and drawings, and from the claims.

DETAILED DESCRIPTION

Figure 1:
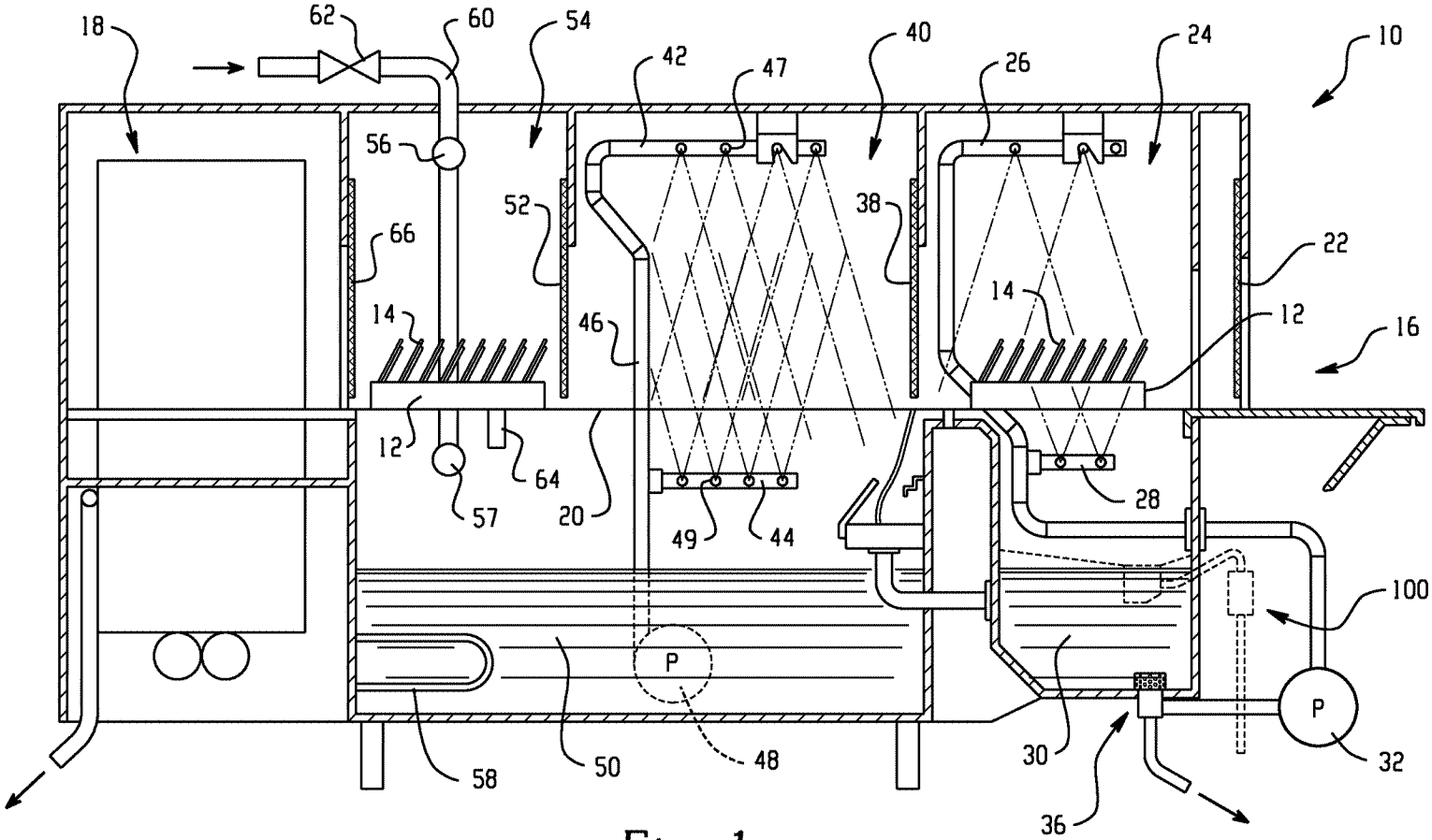
FIG. 1 is a schematic elevation of one embodiment of a warewasher.
Figure 2:
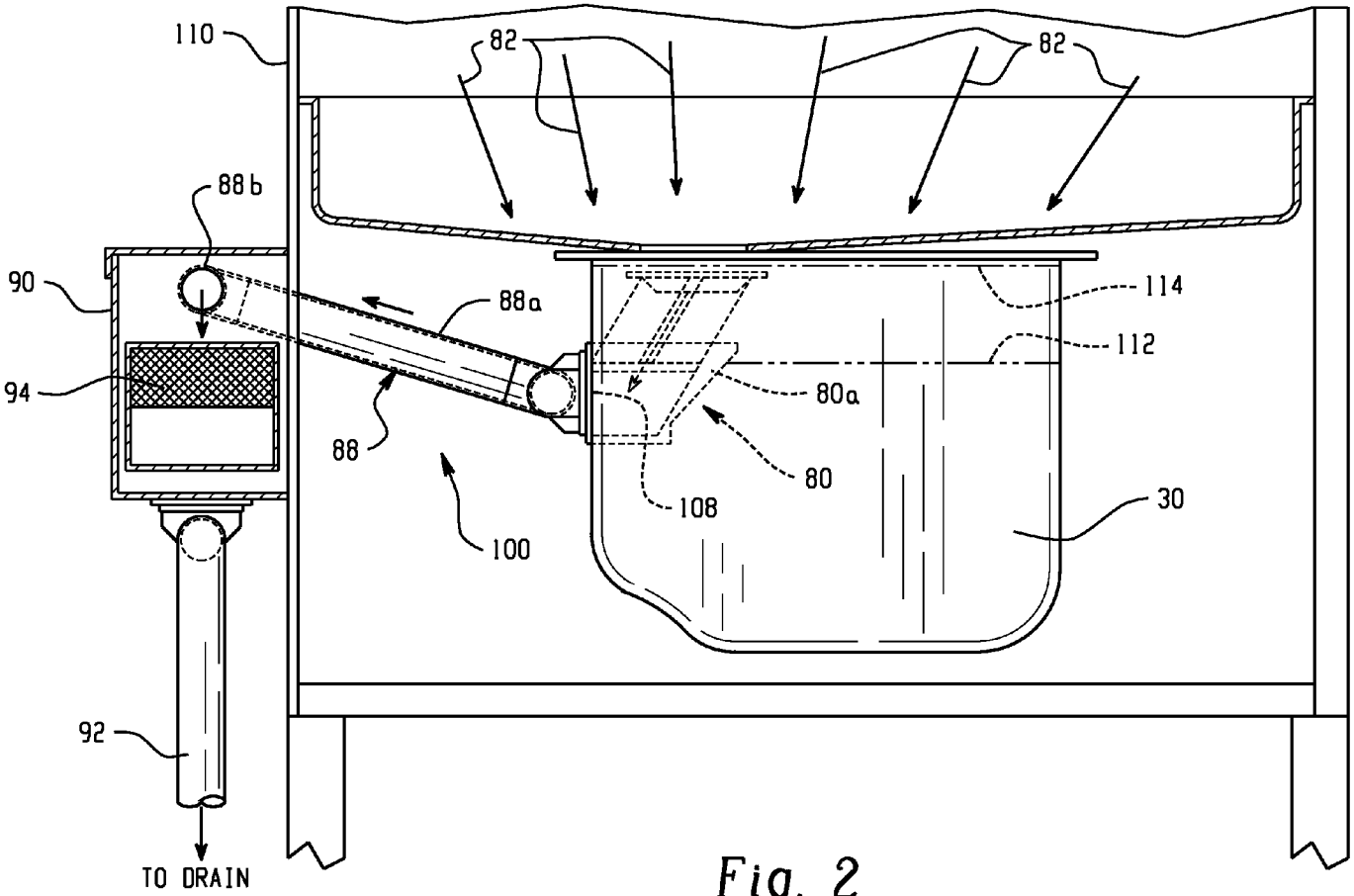
FIG. 2 is a partial schematic view of one embodiment of a scrap reducing arrangement of the warewasher.
Figure 3:
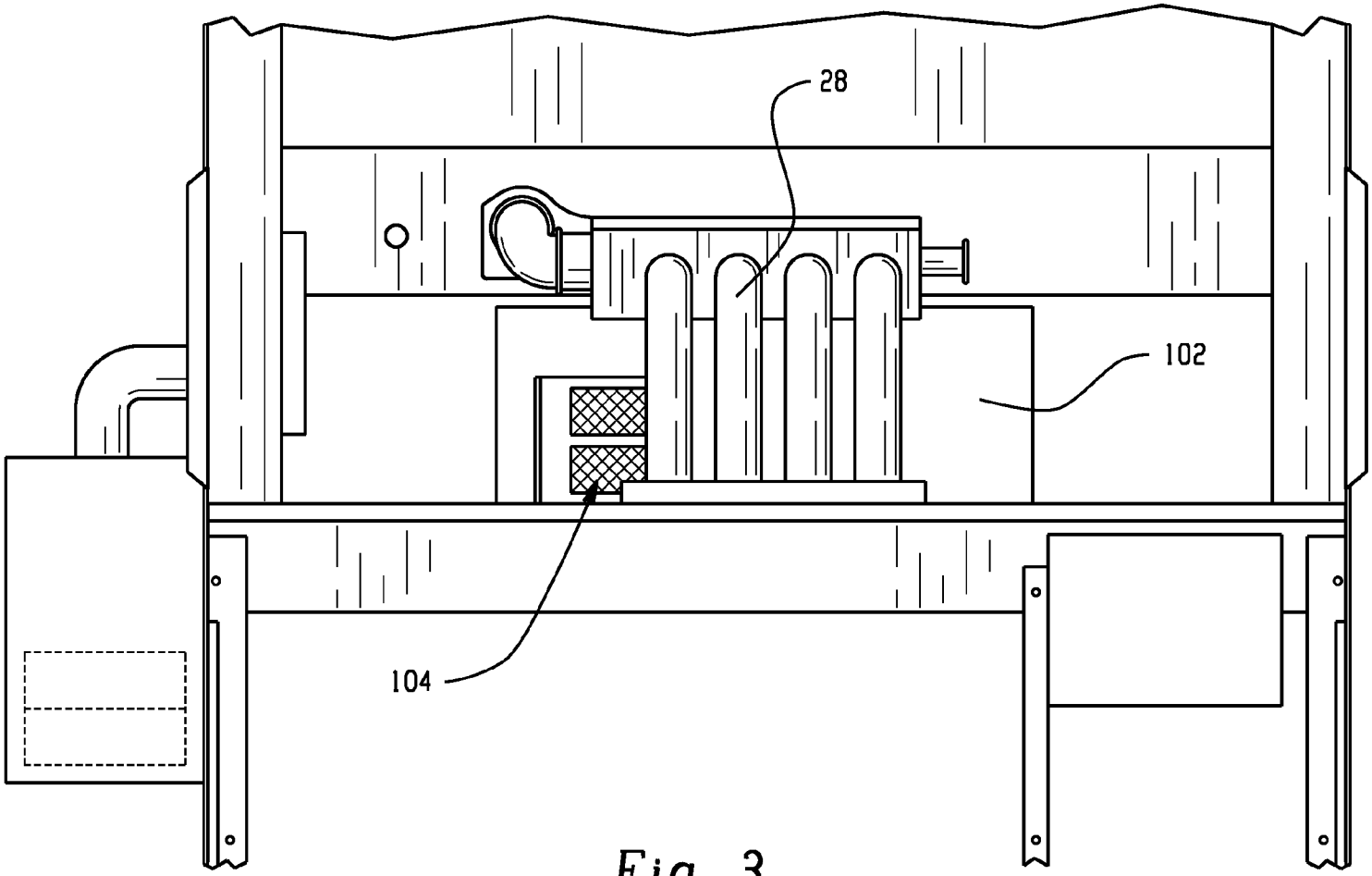
FIG. 3 is a partial perspective view of a wash chamber including the scrap reducing arrangement.
Figure 4:
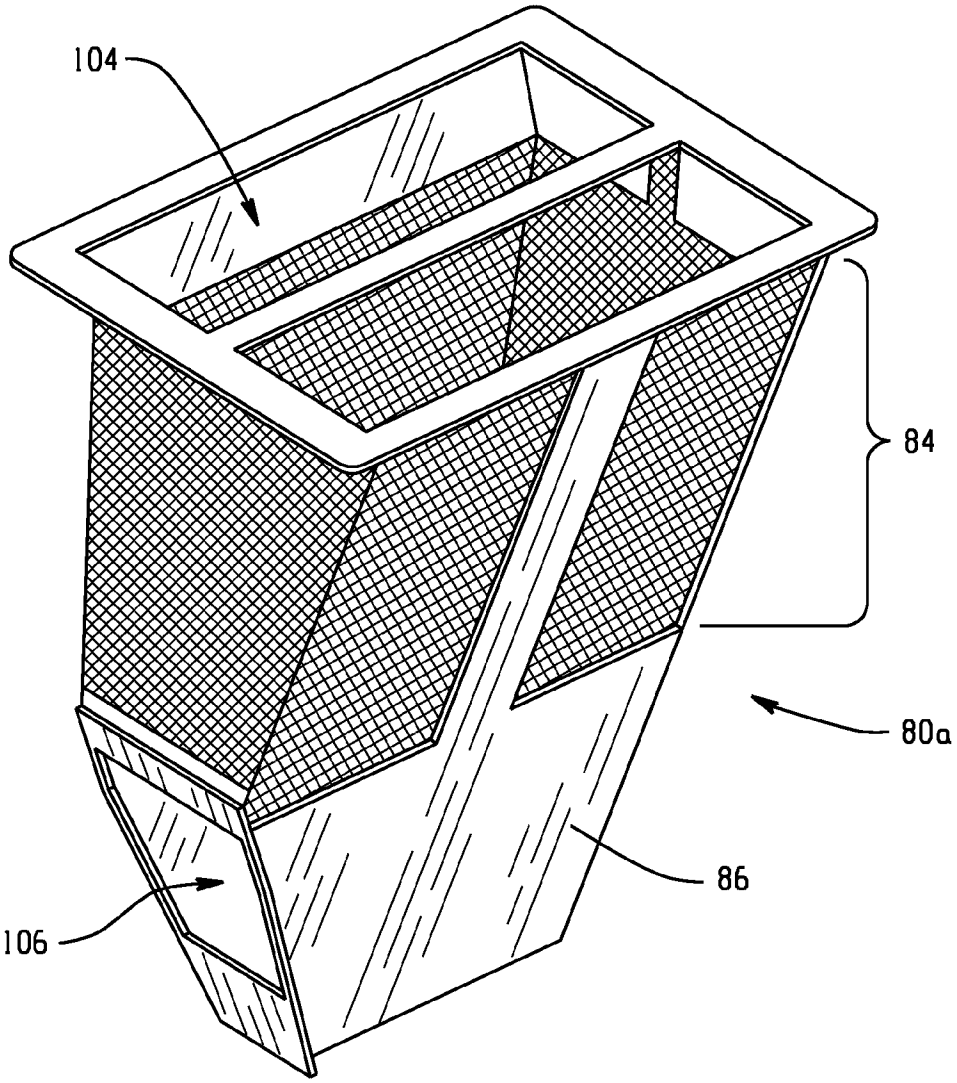
FIG. 4 is a perspective view of a scrap collecting bucket.
Figure 5:
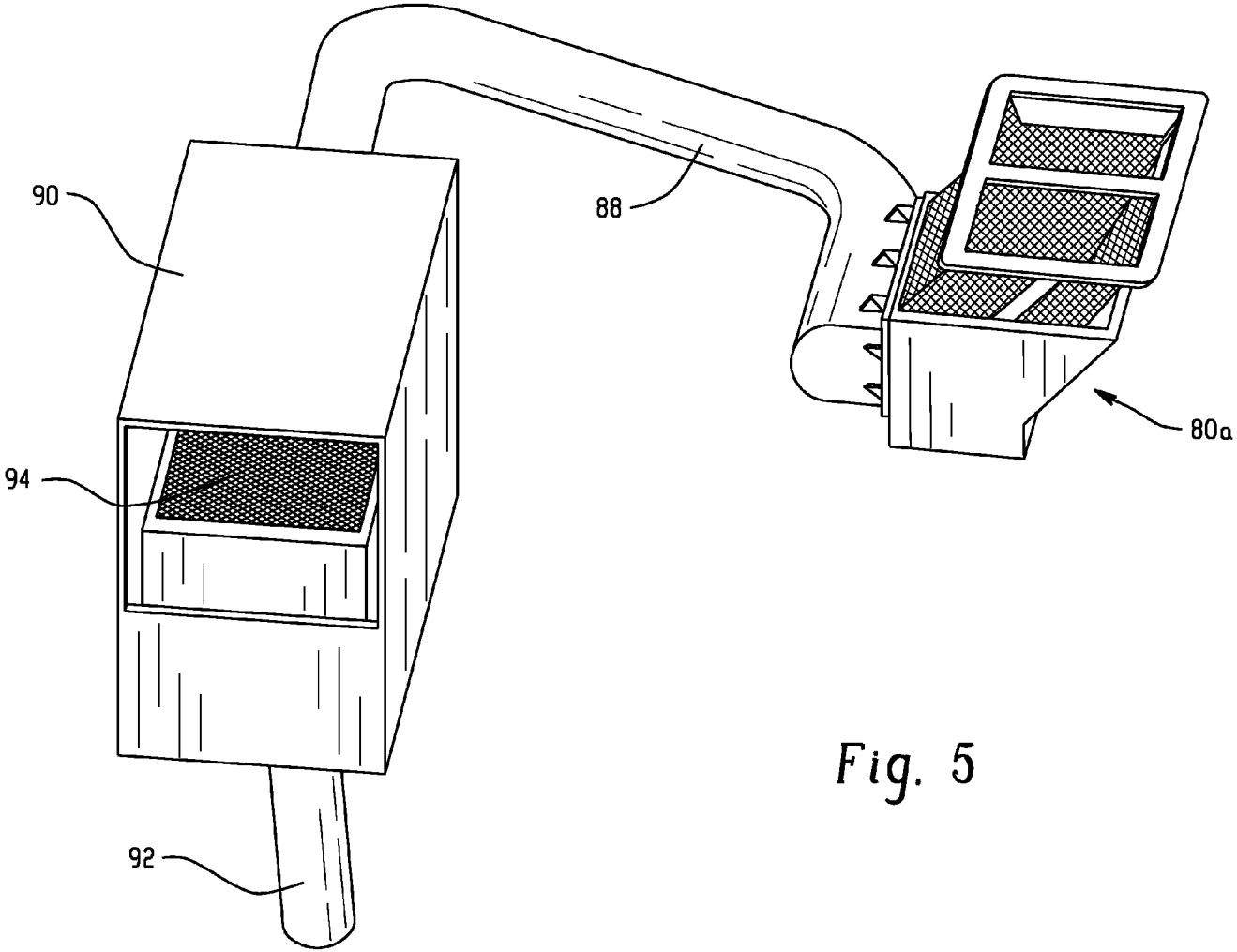
FIG. 5 is a perspective view of the components of the scrap reducing arrangement.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 (optional) at an opposite end of the warewash system by a suitable conveyor mechanism 20. Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 via a pump 32 and supply conduit 34. A drain system 36 provides a single location where liquid is pumped from the tank 30 using the pump 32. Liquid can be drained from the tank via drain path 36, for example, for a tank cleaning operation.

The racks proceed to a next curtain 38 into a main wash chamber or zone 40, where the wares are subject to sprays of cleansing liquid from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 60 under the control of solenoid valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 57. The water then drains from the wares into tank 50. The rinsed rack 12 of wares 14 then exits the final rinse chamber 54 through curtain 66, moving into dryer unit 18.

As suggested in FIG. 1, the warewasher includes a scrap reducing arrangement 100 associated with wash zone 24 and tank 30. Although the scrap reducing arrangement is contemplated primarily for use in the pre-wash zone as shown, it could be incorporated into the main wash zone of a machine as well, or in other zones of the machine if desired.

Referring now to FIGS. 2-5, an exemplary implementation of the scrap reducing arrangement 100 is shown. The scrap reducing arrangement 100 includes a scrap collecting volume 80 to which food and other scrap debris is directed by water flows falling down into the tank 30 (e.g., per arrows 82). A surrounding pan 102 with or without some strainer portions may be used for this purpose (e.g., capturing debris while letting water enter the tank, and enabling the debris to flow to an upper opening 104 of the scrap collecting volume 80). The scrap collecting volume 80 may be defined by a scrap collecting bucket 80*a*, where an upper portion 84 of the scrap collecting bucket includes sides formed of a screening material that enables fluid communication between the volume 80 and the tank 30, permitting water to move from the volume 80 to the tank. A lower portion 86 of the bucket includes solid walls, as that is where the food and other scrap debris primarily collects.

The bucket 80*a* includes an outlet opening 106 in lower portion 86, and the outlet opening 106 aligns with an opening 108 in the sidewall of the tank 30. A purge flow passage 88 (e.g., formed in part by pipe/tube 88*a*) extends from the opening 106 of the scrap collecting bucket to a location away from the tank and out of the wash zone. In this case the tube 88*a* extends to a location external of the primary housing 110 of the warewash machine to a scrap collecting container 90 external of the chamber within the housing. The external scrap collecting container 90 traps food debris but allows liquid to move to a drain path (e.g., via drain tube 92). The external scrap collecting container 90 may include a removable strainer 94, such that personnel may occasionally remove the strainer and empty collected food debris into the garbage or other disposal unit. Notably, this can be done without shutting down the warewash machine.

The purge flow passage 88 from the scrap collecting volume 80 is configured such that during liquid recirculation and spraying within the wash zone a normal operating water level 112 in the tank 30 is below a level that forces collected food debris along the flow passage 88. Specifically, at least a portion of the purge flow passage extends upward as shown so that part (e.g., part 88*b*) of the purge flow passage is higher than both the outlet opening 106 and the normal operating level 112. However, upon cessation of liquid recirculation and spraying within the wash zone, falling liquid in suspension (e.g., which may be on the order of 3-6 gallons or more) not only pushes debris on the pan 102 into the opening 104, but also causes the water level in the tank 30 to rise to a higher level that creates a sufficient head pressure to force collected food and other scrap debris and water to move along the flow passage 88. Specifically, the water level in the tank rises to a level 114 that is higher than the highest flow passage part 88*b*. Thus, the water level in the tank rises to a level that causes a flushing operation to occur along the purge flow passage 88.

In some embodiments the flushing operation may produce a temporary siphon effect (e.g., suction cause by a falling liquid column at the far end of the tube 88*a*) along the purge flow passage 88. In other embodiments, it is simply the large rush of the suspended water into the scrap collecting that flushes the debris along the passage until the water level within the scrap collecting volume falls below the highest flow passage part 88*b*, with little or no siphon effect being created.

When recirculation in the wash zone begins again, the tank water level will again fall to and remain at a level below that which causes flushing. Replenishing of the water level in the wash tank may be achieved by flows of final rinse water that are directed to the wash tank after spraying and/or by a separate replenish path.

Various techniques may be used to initiate the flushing operation. For example, a controller may be configured to at least temporarily stop liquid recirculation and spraying in the wash zone based upon one or more of (i) a timed basis (e.g., every 3-10 minutes) and/or (ii) detection of the absence of wares in the chamber (e.g., based upon one or more rack detectors of the machine) and/or (iii) detection of debris within the scrap collecting bucket.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. For example, although a conveyor-type machine is shown in FIG. 1, the scrap reducing arrangement could be implemented on other machines. Warewash machines are categorized into two types based on the operating modes (i.e., batch or continuous) and this concept is applicable to both machine types. In the case of batch-type machines, the wash chamber of the machine forms the wash zone and the sump at the bottom of the wash chamber forms the tank where the scrap reducing arrangement would be located.

What is claimed is:

1. A warewasher for washing wares, comprising:

a chamber for receiving wares, the chamber having at least one wash zone including a tank for collecting sprayed liquid of the wash zone and a liquid recirculation system for moving liquid from the tank to a spray arrangement of the wash zone;

a scrap reducing arrangement located within the wash zone for capturing scrap debris falling downward toward the tank, the scrap reducing arrangement configured to automatically deliver captured scrap debris away from the tank when liquid spraying within the wash zone ceases;

wherein the scrap reducing arrangement includes a purge flow passage having an inlet below a normal operating liquid level of the tank, and the purge flow passage includes a portion that extends upward to a highest point that is above the normal operating liquid level and below a top of the tank, wherein the purge flow passage is open to permit free flow therealong such that when liquid spraying within the wash zone ceases, liquid in suspension returns to the tank causing an increase in the liquid level of the tank to a level above the highest point resulting in a head pressure in the tank that causes a flushing operation of liquid along the purge flow passage.

2. The warewasher of claim 1 wherein the wash zone is located upstream of a final rinse zone, the warewasher includes a conveyor for moving wares in a conveyance direction through the chamber from the wash zone to the final rinse zone.

3. The warewasher of claim 1 wherein the scrap reducing arrangement includes a scrap collecting volume in the tank and the purge flow passage extends from the scrap collecting volume away from the wash zone, and when liquid spraying within the wash zone ceases, the head pressure causes the flushing operation from the scrap collecting volume along the purge flow passage.

4. The warewasher of claim 3 wherein the purge flow passage leads to a compartment external of the wash zone, the compartment including a strainer to capture flushed scrap debris and a drain outlet to permit flushed liquid to be drained.

5. The warewasher of claim 1, wherein the scrap reducing arrangement includes:

a scrap collecting bucket to which scrap debris is directed by liquid flows falling down into the tank, the scrap collecting bucket including a screening portion in fluid communication with the tank;

the purge flow passage extending from a lower part of the scrap collecting bucket away from the tank and upward to the highest point.

6. The warewasher of claim 5 wherein the purge flow passage extends to a scrap collecting container that traps scrap debris but allows liquid to move to a drain path.

7. The warewasher of claim 6 wherein the scrap collecting container includes a removable strainer.

8. The warewasher of claim 1, further comprising:

a controller configured to at least temporarily stop liquid recirculation and spraying in the wash zone based upon one or more of (i) a timed basis and/or (ii) detection of the absence of wares in the chamber and/or (iii) detection of debris within the scrap collecting bucket.

9. A warewasher for washing wares, comprising:

a chamber for receiving wares, the chamber having at least one wash zone including a tank for collecting sprayed liquid of the wash zone and a liquid recirculation system for moving liquid from the tank to spray nozzles of the wash zone;

a scrap collecting volume positioned in the tank and into which falling scrap debris is directed, the scrap collecting volume including an outlet opening, a purge flow passage extending from the outlet opening to a location external of the wash zone, wherein at least a portion of the purge flow passage extends upward so that a highest part of the purge flow passage is higher than the outlet opening and lower than a top of the tank, wherein the purge flow passage is open to permit free flow therealong.

10. The warewasher of claim 9 wherein the outlet opening is located below a normal liquid level of the tank that exists during liquid recirculation and spraying in the wash zone, and the highest part of the purge flow passage is higher than the normal liquid level and lower than a liquid level that occurs when liquid in suspension returns to the tank.

11. The warewasher of claim 9 wherein the purge flow passage is pump-free.

12. A method of capturing and purging scrap debris from a wash zone of a warewasher, the method comprising:

recirculating a wash liquid from a tank of the wash zone to spray nozzles of the wash zone so as to spray the wash liquid toward wares in the wash zone;

directing scrap debris falling from wares toward and into a scrap collecting volume within the tank, the scrap collecting volume including at least some screening material to remain in fluid communication with the tank, the scrap collecting volume including a scrap purge flow passage extending out of the tank;

at least temporarily stopping the recirculating of wash liquid, causing wash liquid conditions in the wash zone to change so as to move scrap debris in the scrap collecting volume along the scrap purge flow passage;

wherein the scrap purge flow passage includes an upwardly extending portion and upon stopping the recirculating of wash liquid a wash liquid level in the tank rises to a level that is higher than a highest part of the purge flow passage to create a head pressure that forces wash liquid and scrap debris in the scrap collecting volume to move through the scrap purge flow passage and out of the tank.

13. The method of claim 12 wherein the scrap purge flow passage is open to permit free flow therealong and the movement of wash liquid and scrap debris under the head pressure does not use any pump along the scrap purge flow passage.

14. The method of claim 12 wherein the directing step utilizes upper screening material configured to catch and direct scrap debris toward an upper opening of the scrap collecting volume.

15. The method of claim 12 wherein the scrap purge flow passage is configured such that a temporary siphon flow along the scrap purge flow passage occurs until the wash liquid level in the tank drops to a level that is below an inlet to the scrap purge flow passage so as to break the siphon.

16. The method of claim 12 wherein the scrap purge flow passage extends to a scrap collecting container external of the wash zone.

17. The method of claim 16 wherein the external scrap collecting container traps scrap debris but allows liquid to move to a drain path.

18. The method of claim 17 wherein the external scrap collecting container includes a strainer that can be removed for disposal of collected scrap debris.

19. A method of capturing and purging scrap debris from a wash zone of a warewasher, the method comprising:

recirculating a wash liquid from a tank of the wash zone to spray nozzles of the wash zone so as to spray the wash liquid toward wares in the wash zone causing a volume of wash liquid to remain in suspension in the recirculating system and resulting in an operating wash liquid level in the tank;

during the recirculating of wash liquid, directing falling scrap debris into a scrap collecting volume within the tank, the scrap collecting volume including at least some screening material to remain in fluid communication with a main volume of the tank so that wash liquid can flow from the scrap collecting volume to the main volume, wherein a scrap purge flow passage extends from the scrap collecting volume to a location external of the tank, wherein the scrap purge flow passage is open to permit free flow therealong when sufficient head pressure is present in the tank, wherein the scrap purge flow passage is arranged such the operating wash liquid level does not create sufficient head pressure to cause wash liquid flow through the scrap purge flow passage;

temporarily stopping the recirculating of wash liquid, causing at least part of the volume of wash liquid in suspension to fall into the tank to raise the wash liquid level in the tank above the operating wash liquid level to a higher level that creates sufficient head pressure to cause wash liquid flow along the scrap purge flow passage thereby forcing scrap debris in the scrap collecting volume to exit the tank.

20. The method of claim 19 wherein the scrap purge flow passage has an inlet below the operating wash liquid level, and the scrap purge flow passage extends upward from the inlet to a highest point that is above the operating wash liquid level and below the higher level.

* * * * *